US005964422A

United States Patent [19]

Ruokonen et al.

[11] Patent Number: 5,964,422

[45] Date of Patent: Oct. 12, 1999

[54] SEALED CRUSHER

[75] Inventors: Markku Ruokonen, Lempäälä ; Olli Aho, Tampere, both of Finland

[73] Assignee: Nordberg-Lokomo Oy, Tampere, Finland

[21] Appl. No.: 09/051,983

[22] PCT Filed: Oct. 23, 1996

[86] PCT No.: PCT/FI96/00561

§ 371 Date: Jun. 17, 1998

§ 102(e) Date: Jun. 17, 1998

[87] PCT Pub. No.: WO97/15395

PCT Pub. Date: May 1, 1997

[30] Foreign Application Priority Data

Oct. 25, 1995 [FI] Finland ..... 955088

[51] Int. Cl.[6] ..... B02C 2/00

[52] U.S. Cl. ..... 241/216

[58] Field of Search ..... 241/207–216

[56] References Cited

U.S. PATENT DOCUMENTS

| | | | |
|---|---|---|---|
| 3,080,126 | 3/1963 | Kueneman et al. | 241/216 |
| 3,473,743 | 10/1969 | Winter | 241/216 |
| 4,602,746 | 7/1986 | Stockmann et al. | 241/216 |
| 5,775,607 | 7/1998 | Bayliss et al. | 241/216 |
| 5,803,382 | 9/1998 | Ganser et al. | 241/216 |

FOREIGN PATENT DOCUMENTS

| | | | |
|---|---|---|---|
| 673351 | 3/1939 | Germany . | |
| 1243955 | 7/1967 | Germany . | |
| 1507573 | 9/1970 | Germany . | |
| 771430 | 4/1957 | United Kingdom | 241/216 |

*Primary Examiner*—Mark Rosenbaum

*Attorney, Agent, or Firm*—Burns, Doane, Swecker & Mathis, L.L.P.

[57] ABSTRACT

A gyratory crusher having a frame (1) and in the frame an eccentric shaft (3) rotatable around a vertical shaft in the frame, with a vertical inclined hole in it. A main shaft (4) is supported by bearings in the hold of the eccentric shaft, a supporting cone (5) being attached to the upper end of said main shaft (4). Around the main shaft, below the supporting cone (5) there is a sealing cover (10) covering the eccentric shaft. The upper edge (12) of the sealing cover (10) is sealed against the main shaft (4) by means of a sealing member (13), the outer edge of which has been fitted in an annular groove (17) on the inner edge (12) of the sealing cover (10). The face-to-face arranged upper and lower surfaces so the part (13") of the sealing member (13) in the groove and the groove (17) of the sealing cover (10) are inclined so that their outer edges are higher up than their inner edges.

20 Claims, 3 Drawing Sheets

1
13
10
8
9
5
24
12
11
21
2
3

SEALED CRUSHER

TECHNICAL FIELD

The present invention concerns gyratory crushers. More particularly the invention concerns sealing, by means of which the internal parts of the crusher are protected against dust entering from outside.

BACKGROUND ART

Gyratory crushers comprise a vertical eccentric shaft with an inclined inner hole therein. A main shaft, into which a supporting cone is attached, and which is supported to the frame at its upper part by means of an upper supporting bearing, is mounted in the hole. The supporting cone is surrounded on its sides by the frame of the crusher, an element acting as a wearing part called outer crushing head being attached to the frame. An element acting as a wearing part called inner crushing head is attached to the supporting cone. The inner and outer crushing heads, together, form a crushing chamber, where the feed material is crushed. When the eccentric shaft is rotated, the main shaft and, together with it, the supporting cone get to an oscillating movement, whereby the gap between the inner and outer head at each point varies during the working cycle. The smallest gap during the working cycle is called the setting of the crusher, and the difference between the minimum and maximum gap is called the stroke of the crusher. Through the magnitude of the setting and the stroke of the crusher, inter alia the particle size distribution of the produced crushed material and the production capacity can be influenced.

Presently, a gyratory crusher can be adjusted by means of a hydraulic system, so that the main shaft can be moved vertically in relation to the frame. This makes it possible to change the setting so that the size of the final product corresponds to the desired one and/or to maintain the same setting when the crushing heads wear.

Dust particles and other foreign objects from the crushing chamber must be prevented from entering the bearings of the eccentric shaft and the main shaft, as well as the primary and secondary gear of the drive device, and in general the lubricant circuit inside the crusher, and through that the surfaces of the elements to be lubricated.

In the crushers of prior art, generally used presently, there is for this purpose a sealing cover around the eccentric shaft and the drive devices connected with it, attached at its lower edge to the frame, and above it as an extension a narrower cylindrical supporting sleeve for the sealing. For the upper edge of the supporting sleeve, there is an annular recess formed in the lower surface of the supporting cone. The outer surface of the supporting sleeve forms a sealing surface, against which a seal ring in the recess of the supporting cone is pressed. The seal ring glides in its recess in relation to the supporting cone along a spherical surface. In addition, when the setting of the crusher is adjusted, the seal ring glides up and down along the surface of the supporting sleeve. The ring can also glide around the supporting sleeve against the surface of the sleeve.

The most essential drawback of this prior art is that the recesses and grooves formed in the supporting cone for sealing members make the supporting cone weaker. Other drawbacks of the prior art are the complicated shape of the lower surface of the supporting cone—and thus high production costs—as well as the fast wearing of the seal ring caused by the required great movement of the seal ring.

Because in these constructions known in the art, the sealing member rises or lowers with the main shaft of the crusher when the vertical position of the main shaft is adjusted, the consequence is that also its distance from the upper supporting bearing, that is its radius of oscillation changes. For this reason, it has been necessary to dimension the sealing against the cone in this structure as a compromise between different radii of oscillation, and some clearance has been reserved to it for extreme positions.

In publication DE 673 351, there has been described a crusher, in which the sealing cover is sealed against the main shaft so, that the outer edge of a horizontal sealing member has been fitted in an internal recess provided in the upper part of the sealing cover. A drawback of this known solution is, however, that little by little the oscillating movement of the main shaft causes the sealing to break, even if it is made of flexible material. Alternatively, big clearances must be used, whereby the tightness of the construction will be lost.

In publication DE 1 243 955, there is described a crusher, in which the lower surface of the outer edge of a sealing member between the main shaft and the sealing cover is fitted tightly against the frame of the crusher. In case the main shaft is lifted upwards in order to change the setting, the sealing member departs from the surface of the crusher frame.

Publication DE 1 507 573 discloses a crusher, in which the sealing members between the main shaft and the sealing cover are completely unprotected from above, and thus subject to dust, whereby the surfaces wear very quickly. It is also not unambiguously clear from the publication, how the sealing cover and the sealing member remain in position when the setting is changed.

DISCLOSURE OF THE INVENTION

General Description

The present invention relates to a crusher.

The most essential feature of the invention is that the sealing cover is sealed against the main shaft, and shaped so as not to be broken by the oscillating movement of the main shaft. The tightness will also be maintained when the setting of the crusher is changed, because the sealing cover and the sealing member do not move in relation to the frame when the setting of the crusher is changed. Also the sealing itself is protected against dust.

A further advantage of the structure in accordance with the present invention is that the supporting cone can be made stronger, as there is no need to make any recess for the supporting sleeve of the sealing. In addition, the supporting cone is more easily manufactured. The lower surface of the supporting cone can be even left as a cast surface, and no smooth machined surface is required on it, against which the sealing would be fitted, as in the structures of prior art. The sealing structure is also in other respects simpler and more economical and secure than the known solutions.

As the sealing has been moved from the sealing sleeve inwards against the main shaft, the circumference of the circle where the sealing is effected is shorter. For this reason, also the required sealing member is smaller. Also the speed of the movement of the sealing member—and thereby the wearing of the sealing member—is reduced.

As in the solution in accordance with the invention there is always oil in the space below the sealing member, providing the lubrication of the bearings of the crusher, the same oil is also provided on the surface of the main shaft below the sealing member. As the main shaft, along with the wearing of the crushing heads, as a rule must be raised, the sealing member always receives clean oil free of dust, thus preventing the wearing of the sealing member.

In a structure in accordance with the present invention, the main shaft glides in relation to the sealing member, when the vertical position of the main shaft is adjusted, whereby the radius of oscillation is independent of the position of the main shaft and always constant. Therefore the sealing member can be positioned with an optimal clearance or even without any clearance, whereby also its sealing effect is good.

The sealing of the internal circumference of the sealing member can be improved by placing one separate sealing or a plurality of individual sealings between the internal circumference and the main shaft. In this way, also the wearing of the internal circumference of the sealing member can be reduced.

In the structure in accordance with the present invention, the balancing of the crusher can also be easily provided without increasing the height of the crusher, because in the structure in accordance with the invention, there will be more space vacant for the counter weight. The space vacant below the supporting cone can be utilised, and the counter weight can be constructed correctly for every stroke.

It is also known to use compressed, in crushers to prevent dust from entering on the sealing member and therefrom further the bearings of the machine. In the structure in accordance with the invention, it is possible to provide the sealing cover with a channel, and bring the compressed air directly to the sealing.

DESCRIPTION OF DRAWINGS

Enclosed drawings form a part of the description of the invention.

EXAMPLES

Figure 1:
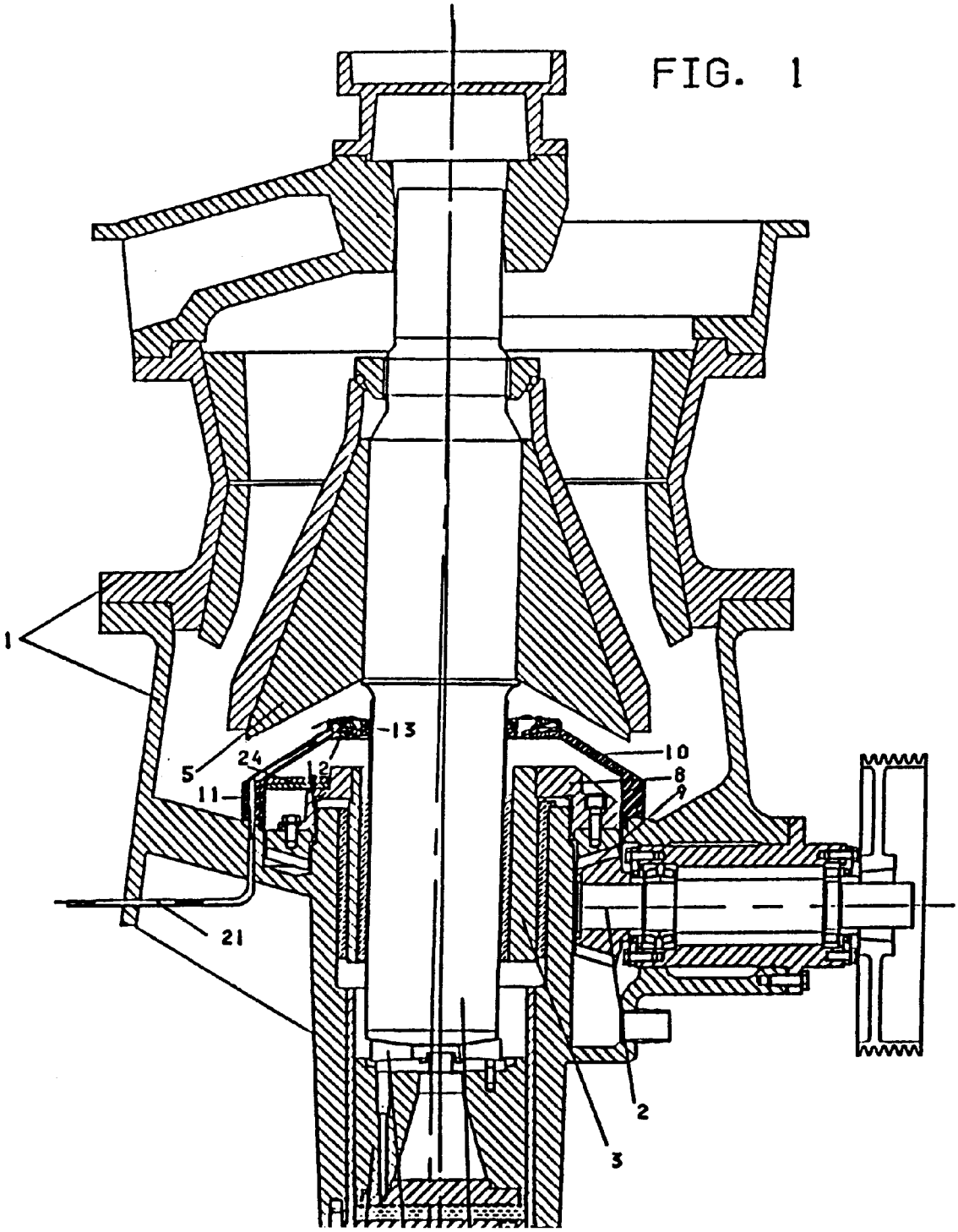
FIG. 1 illustrates one gyratory crusher in accordance with the present invention.

The main parts of the crusher of FIG. 1 are a frame 1, a transmission mechanism 2, an eccentric shaft 3, a main shaft 4 and a supporting cone 5 arranged on the main shaft.

An outer crushing head attached to the upper part of the frame 1 and an inner crushing head attached to the supporting cone 5 form a crushing chamber. To the lower part of the frame there is arranged the transmission mechanism 2, by means of which the eccentric shaft 3 is rotated.

The lower end of the main shaft 4 is via bearings 6 supported to an adjusting piston 7 arranged at the lower part of the frame 1. By leading pressure medium into a cylinder below the adjusting piston or from the cylinder, the main shaft can be raised or lowered in relation to the frame.

The upper end of the eccentric shaft 3 is provided with a pole ring 8 with counter weights. The lower edge of the pole ring is provided with a bevel gear 9.

The eccentric shaft 3 is covered with a sealing cover 10. The skirt 11 of the outer edge of the sealing cover is tightly fixed to the lower part of the crusher frame 1. The inner edge 12 is sealed against the main shaft 4 by means of a sealing member 13. The sealing member can be shaped e.g. as shown in the drawings.

The sealing cover is dimensioned so that between the main shaft and the inner edge of the sealing cover there is left a space or a groove required by the sealing member.

The outer surface of the sealing cover 10 is inclined downwards and outwards. Thus, no crushed stone is gathered upon it.

Figure 2:
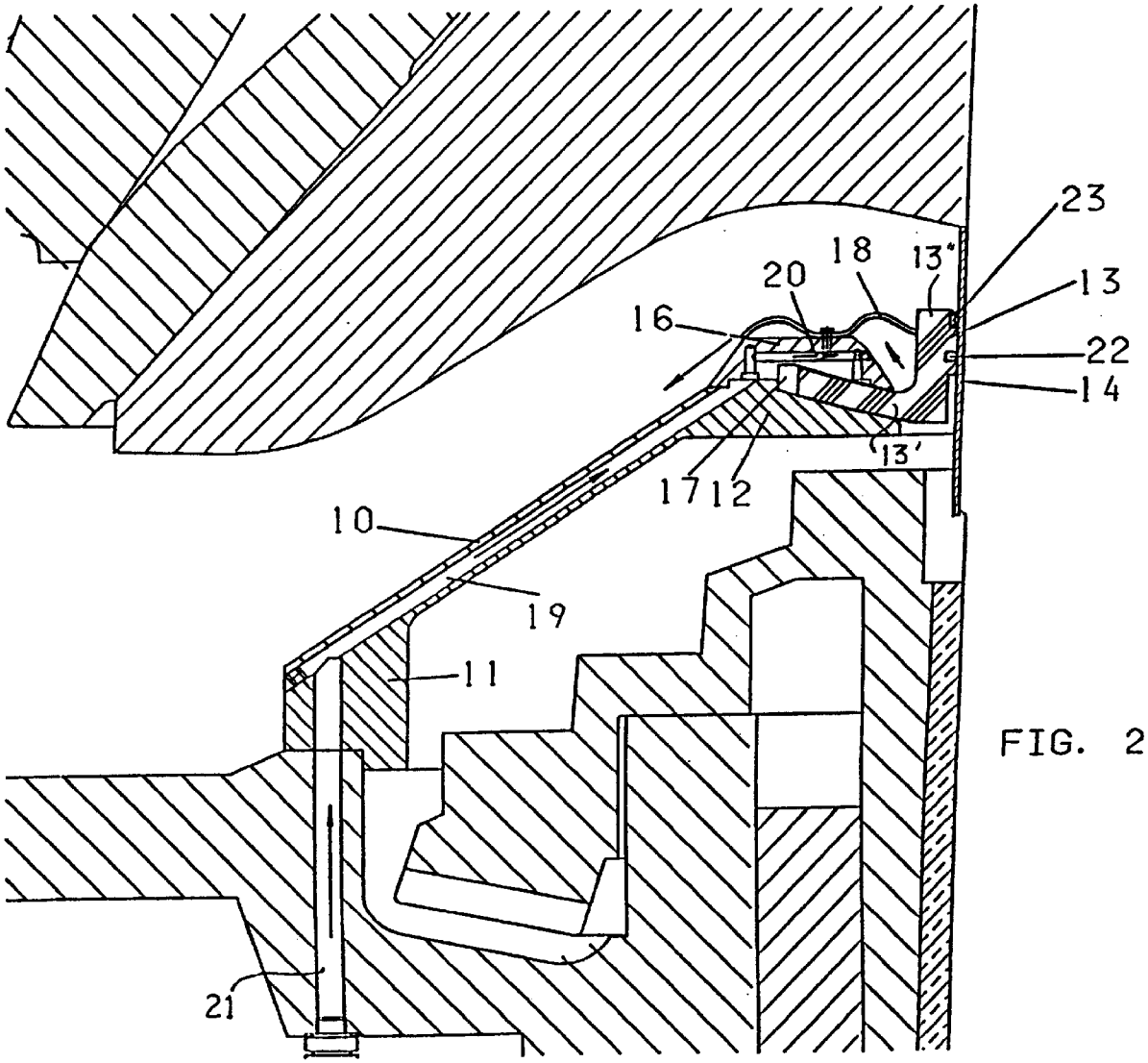
FIG. 2 shows an enlarged detail of the crusher of FIG. 1.

In FIG. 2, the structure of the sealing member is shown in more detail. The sealing member 13 is formed of a flangelike part 13' and of a sleevelike part 13" within it, extending upwards from the inner edge of the flangelike part.

Against the inner circumference of the sealing member 13, there can be a cylindrical protective sleeve 14 pressing tightly against the main shaft.

The inner edge 12 of the sealing cover 10 forms an annular flange. A fixing ring 16 is arranged above the flange so that a groove 17 is formed between for the sealing member 13. The groove has a form of the sealing member, but it is sideways wider than it, so the upper and lower surfaces of the flange part 13' of the sealing member 13 set tightly against the groove, but, however, can move sideways in it along the movement of the main shaft 4.

The face to face arranged upper and lower surfaces of the groove 17 of the sealing cover 10 and the flangelike part 13' of the sealing member are parts of a spherical surface, the centre of which is the centre of the oscillating movement of the main shaft at the upper end of the main shaft 4.

On top of the fixing ring 16 of the sealing member there is, in addition, a protective ring 18 made of some elastic material.

A channel 19 is formed in the sealing cover 10, the main part of which is parallel with the cover and joins a channel 20 of the fixing ring 16, which again opens at the lower surface of the fixing ring against the sealing member 13. Through the channels 19, 20, compressed air can be blown to the sealing member from a pipe 21, for removing dust from the upper surface of the sealing member 13 gliding against the groove 17.

In addition, the sealing member 13 can be provided with one or several separate seal rings 22, 23 which seal the gap between the sealing member and the main shaft or the sealing member and the protective sleeve 14. The seal ring 23 can be a changeable, elastic ring, that scrapes the main shaft when the main shaft is raised and lowered.

When the main shaft 4 is making its oscillating movement, the centre of mass of the main shaft and the masses fastened to it changes its position. Therefore the masses connected with the pole ring 8 of the eccentric shaft of the crusher must be dimensioned so as to balance the forces caused by the movement of the main shaft and the centre of mass of the masses connected with it, and thus decrease the swinging of the crusher.

With different stroke movements, the path of movement of the main shaft and the centre of mass of the masses connected with it is different. For this reason, the position or magnitude of the masses connected with the pole ring of the eccentric shaft should be adjustable. In a structure in accordance with the invention, more room will be left above the pole ring 8 and thus detachable or adjustable counter weights 24 (FIG. 1) can be attached to the pole ring, and these counter weights can be added, removed or moved according to need in order to balance the crusher with different stroke movements.

The protective ring 18 can be also replaced e.g. with a rubber bellow. This kind of a rubber bellow can extend to be tightly against the protective sleeve 14 or the main shaft 4 itself.

Figure 3:
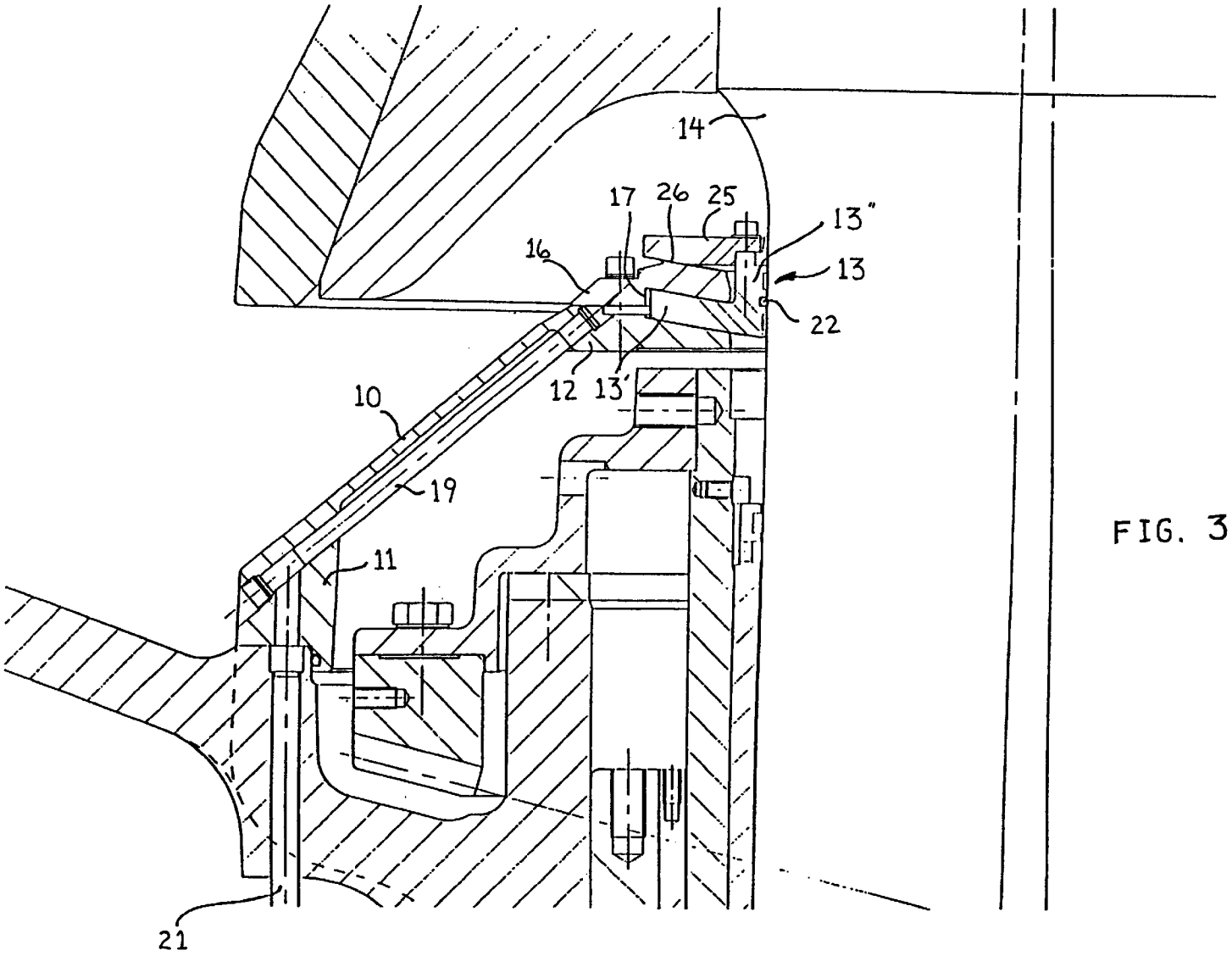
FIG. 3 shows as enlarged an alternative embodiment of the detail of FIG. 1.

FIG. 3 illustrates an alternative embodiment of the sealing arrangement. There the elastic protective ring 18 on top of the fixing ring 16 has been replaced by a protective ring 25 which is attached to the sealing element 13 so, that the lower surface of the protective ring is in contact with the protective cover. The contact surface 26 between the sealing member and the protective ring is conical or a part of a spherical surface.

Thus, the protective ring oscillating with the seal ring maintains its contact with the fixing ring 16. The protective ring 25 is attached to the upper surface of the sleeve part 13" of the sealing member, whereby it properly also protects the seal ring from dust.

In the embodiments of both the FIG. 2 and FIG. 3, the upper and lower surfaces of the sealing member 13 and the groove 17 do not necessarily have to be exactly spherical surfaces, but also slightly inclined conical surfaces following closely to these kinds of spherical surfaces can be used.

Because the distance between the sealing member and the centre of the oscillating movement of the main shaft is in practice long compared with the length of the flangelike part 13' of the sealing member, the spherical surfaces of the face to face upper and lower surfaces of the groove 17 of the sealing cover 10 and the flangelike part 13' of the sealing member can be replaced by conical surfaces forming with the centre axis of the crusher an angle which is smaller than 90°. It is essential that the outer surfaces of both the groove 17 of the sealing cover 10 and the flangelike part 13' of the sealing member are higher up than their inner edges.

The sealing member can also be shaped so that there is no sleevelike part 13" in it. Thereby the separate seal rings 22, 23 can be arranged in a narrow area on the inner edge of the sealing member.

We claim:

1. A gyratory crusher having a frame;

an eccentric shaft rotatable around a vertical axis in the frame, with a vertical inclined hole therein;

a main shaft supported by bearings in the hole of the eccentric shaft, said main shaft comprising an upper end extending above the eccentric shaft, and a supporting cone attached and supported thereto, and arranged around the main shaft, below the supporting cone, a sealing cover covering the eccentric shaft, said sealing cover having an inner edge, and an outer edge fastened tightly to the frame, whereby the sealing cover is sealed against the main shaft with a sealing member so that contact surfaces between the sealing cover and the sealing member are formed in an annular groove and a part fitted in the groove, said groove having the shape of the part fitted in the groove, but being sideways wider than the portion of said part fitted in said groove, wherein the contact surfaces of both said groove and the part fitted in said groove are inclined in such a way that radially outer edges of said groove and the part are higher than radially inner edges of said groove and the part.

2. A gyratory crusher in accordance with claim 1, wherein the groove is arranged on the inner edge of the sealing cover, and the part is a part of the sealing member.

3. A gyratory crusher in accordance with claim 2, wherein the face to face arranged upper and lower surfaces of the groove and the part define annular, partial surfaces of a sphere, a center of the sphere being a center of oscillating movement of the main shaft at the upper end of the main shaft.

4. A gyratory crusher in accordance with claim 2, wherein the sealing member includes a flangelike part and a sleevelike part within it.

5. A gyratory crusher in accordance with claim 2, wherein the inner edge of the sealing cover is sealed against the main shaft via a protective sleeve fitted against the main shaft.

6. A gyratory crusher in accordance with claim 1, wherein the groove is arranged between the sealing cover and a fixing ring on top of it, and the part is a part of the sealing member.

7. A gyratory crusher in accordance with claim 6, wherein the face to face arranged upper and lower surfaces of the groove and the part define annular, partial surfaces of a sphere, a center of the sphere being a center of the oscillating movement of the main shaft at the upper end of the main shaft.

8. A gyratory crusher in accordance with claim 6, wherein the sealing member includes a flangelike part and a sleevelike part within it.

9. A gyratory crusher in accordance with claim 6, wherein a protective cover is arranged on top of the sealing member and the fixing ring whereby the contact surfaces between the fixing ring and the protective cover are inclined in such a way that radially outer edges of the fixing ring and the protective cover are higher than radially inner edges of the fixing ring and the protective cover.

10. A gyratory crusher in accordance with claim 1, wherein the face to face arranged upper and lower surfaces of the groove and the part define annular, partial surfaces of a sphere, a center of the sphere being a center of oscillating movement of the main shaft at the upper end of the main shaft.

11. A gyratory crusher in accordance with claim 10, wherein the sealing member includes a flangelike part and a sleevelike part within it.

12. A gyratory crusher in accordance with claim 1, wherein the sealing member includes a flangelike part and a sleevelike part within it.

13. A gyratory crusher in accordance with claim 1, wherein the inner edge of the sealing cover is sealed against the main shaft via a protective sleeve fitted against the main shaft.

14. A gyratory crusher in accordance with claim 1, wherein between the sealing member and the main shaft there is at least one changeable seal ring.

15. A gyratory crusher in accordance with claim 1, wherein between the sealing member and the main shaft there is a changeable elastic ring that scrapes the main shaft when the main shaft is raised or lowered.

16. A gyratory crusher in accordance with claim 1, wherein there is a channel in the sealing cover, one end of the channel joining a compressed air pipe arranged outside of a crushing chamber, and a second end of the channel opening onto the sealing member.

17. A gyratory crusher in accordance with claim 16, wherein the second end of the channel opens onto the sealing member via a channel arranged in a fixing ring of the sealing member.

18. A gyratory crusher in accordance with claim 1, wherein a lower surface of the supporting cone includes a cast surface.

19. A gyratory crusher in accordance with claim 1, wherein a lower surface of the supporting cone is without a recess machined in it for sealing.

20. A gyratory crusher in accordance with claim 1, wherein one or several detachable or adjustable counter weights are attached to a pole ring on the upper end of the eccentric shaft.

* * * * *